US007895675B2

(12) United States Patent
Curphey

(10) Patent No.: US 7,895,675 B2
(45) Date of Patent: Mar. 1, 2011

(54) WEIGHTED BELT

(75) Inventor: Craig E. Curphey, Barrie (CA)

(73) Assignee: Wellness Belts Inc., Barrie (CA)

( * ) Notice: Subject to any disclaimer, the term of this patent is extended or adjusted under 35 U.S.C. 154(b) by 549 days.

(21) Appl. No.: 11/775,413

(22) Filed: Jul. 10, 2007

(65) Prior Publication Data

US 2008/0010724 A1 Jan. 17, 2008

Related U.S. Application Data

(63) Continuation-in-part of application No. 11/475,310, filed on Jun. 27, 2006, now abandoned.

(30) Foreign Application Priority Data

Dec. 1, 2006 (CA) ..... 2569816

(51) Int. Cl.
*A41F 9/00* (2006.01)
*A63B 21/065* (2006.01)

(52) U.S. Cl. ..... 2/338; 482/105

(58) Field of Classification Search ..... 2/338, 2/339, 250; 602/19; 405/186; 482/405, 482/124

See application file for complete search history.

(56) References Cited

U.S. PATENT DOCUMENTS 1,421,451 A * 7/1922 Garberding ..... 224/587
1,792,158 A * 2/1931 Gleckner ..... 2/322
1,911,256 A * 5/1933 Andrew ..... 224/247
2,159,857 A * 5/1939 Mix ..... 2/301
2,718,043 A * 9/1955 Wallace ..... 24/178
2,916,742 A * 12/1959 Sobel ..... 2/322
3,017,641 A * 1/1962 Stollman ..... 2/322
3,374,636 A * 3/1968 Mason ..... 405/186
3,525,141 A * 8/1970 Smith ..... 29/428
3,532,339 A * 10/1970 Smith ..... 482/105
3,713,299 A 1/1973 Duncan
4,151,936 A * 5/1979 Hawkes ..... 224/676
4,239,211 A * 12/1980 Wilkerson ..... 482/105
4,326,533 A * 4/1982 Henderson ..... 607/112
4,384,369 A * 5/1983 Prince ..... 2/79
4,396,190 A * 8/1983 Wilkerson ..... 482/105
4,407,497 A * 10/1983 Gracie ..... 482/105
4,440,525 A * 4/1984 Perla ..... 405/186
4,447,913 A * 5/1984 Engelson ..... 2/338
4,617,685 A * 10/1986 Grandis ..... 2/338
4,639,948 A * 2/1987 Adell ..... 2/338
4,676,247 A * 6/1987 Van Cleve ..... 607/112
4,732,305 A * 3/1988 Courtney et al. ..... 405/186
4,808,033 A * 2/1989 Belmonte ..... 405/186
4,854,319 A * 8/1989 Tobin ..... 607/109
4,917,280 A * 4/1990 Schneider ..... 224/223
4,958,386 A * 9/1990 Louis-Jeune ..... 2/227

(Continued)

*Primary Examiner*—Alissa L Hoey
(74) *Attorney, Agent, or Firm*—Pearne & Gordon LLP

(57) ABSTRACT

A weighted belt is provided. The weighted belt comprises a belt body that defines a body pocket; a plurality of weights disposed within the body pocket; a first cinching end that extends from an end of the belt body; and, a second cinching end that extends from an opposite end of the belt body. The first and second cinching ends comprise a suitable dress-belt material disposed on at least a portion of the surface of the belt body sufficient to conceal at least partially the belt body when worn and viewed face on, and are configured for releasable engagement.

18 Claims, 4 Drawing Sheets

U.S. PATENT DOCUMENTS 4,966,365 A * 10/1990 Winston ..... 482/105
5,005,374 A * 4/1991 Spitler ..... 62/259.3
5,075,902 A * 12/1991 McReynolds et al. ..... 2/238
5,076,575 A * 12/1991 Eylander ..... 482/105
5,120,288 A * 6/1992 Sinaki ..... 482/105
5,144,694 A * 9/1992 Conrad Da oud et al. ..... 2/69
5,337,417 A * 8/1994 Whiteside et al. ..... 2/463
5,450,858 A * 9/1995 Zablotsky et al. ..... 128/876
5,501,180 A * 3/1996 Beere ..... 119/858
5,515,550 A * 5/1996 Friedman et al. ..... 2/338
5,547,445 A * 8/1996 Chang ..... 482/105
5,713,840 A * 2/1998 Brentham ..... 602/19
5,826,280 A * 10/1998 Bradley ..... 2/322
5,868,652 A * 2/1999 Spletzer ..... 482/105
6,050,463 A * 4/2000 De Bono et al. ..... 224/178
6,146,053 A * 11/2000 Nelson ..... 405/186
6,189,154 B1 * 2/2001 Ducharme ..... 2/338
6,244,997 B1 * 6/2001 Cook ..... 482/105
6,427,697 B1 * 8/2002 Pearcey ..... 128/876
6,554,787 B1 * 4/2003 Griffin et al. ..... 602/74
7,063,650 B1 * 6/2006 Beausoleil ..... 482/105
D578,751 S * 10/2008 Holtzclaw, Jr. ..... D3/224
2001/0019986 A1 * 9/2001 Cook ..... 482/105
2002/0104151 A1 * 8/2002 Rauscher ..... 2/338
2003/0233700 A1 * 12/2003 Cress ..... 2/338
2004/0220502 A1 * 11/2004 Arden ..... 602/19
2006/0090248 A1 * 5/2006 McKenzie et al. ..... 2/338
2007/0049854 A1 3/2007 Teimourian
2007/0249978 A1 * 10/2007 Curphey ..... 602/19
2009/0253560 A1 * 10/2009 Cook ..... 482/105

* cited by examiner

WEIGHTED BELT

CROSS-REFERENCE TO RELATED APPLICATION

This application is a Continuation-in-Part of U.S. patent application Ser. No. 11/475,310 filed Jun. 27, 2006, which is incorporated herein by reference in its entirety.

FIELD OF INVENTION

The present invention relates to belts, in general. In particular, the present invention relates to weighted belts.

BACKGROUND OF THE INVENTION

People need exercise. Weight bearing exercise has been shown to increase bone mass and thereby prevent or delay the onset of degenerative disorders such as osteoporosis. However, increased sedentary lifestyles leave little time or opportunity for such exercise. There exists a need for providing weight bearing exercise that accommodates increasingly sedentary lifestyles.

SUMMARY OF THE INVENTION

A weighted belt is provided. The weighted belt comprises a belt body that defines a body pocket; a plurality of weights disposed within the body pocket; a first cinching end that extends from an end of the belt body; and, a second cinching end that extends from an opposite end of the belt body. The first and second cinching ends comprise a suitable dress-belt material disposed on at least a portion of the surface of the belt body sufficient to conceal the belt body when worn and viewed face on, and are configured for releasable engagement.

The belt body may have a length sufficient to span a belt wearer's back and at least a portion of the belt wearer's sides.

The belt body may have a length sufficient to span a belt wearer's back, sides and at least a portion of the belt wearer's front.

At least one of the first and second cinching ends may be releasably securable to the belt body and repositionable along its length relative to the belt body so as to alter the overall length of the weighted belt.

Each of the plurality weights may articulate with an adjacent weight in at least two axes of movement.

Each of the plurality of weights may comprise a lead alloy.

The lead alloy may comprise lead and antimony.

DETAILED DESCRIPTION OF THE PREFERRED EMBODIMENTS

Figure 1:
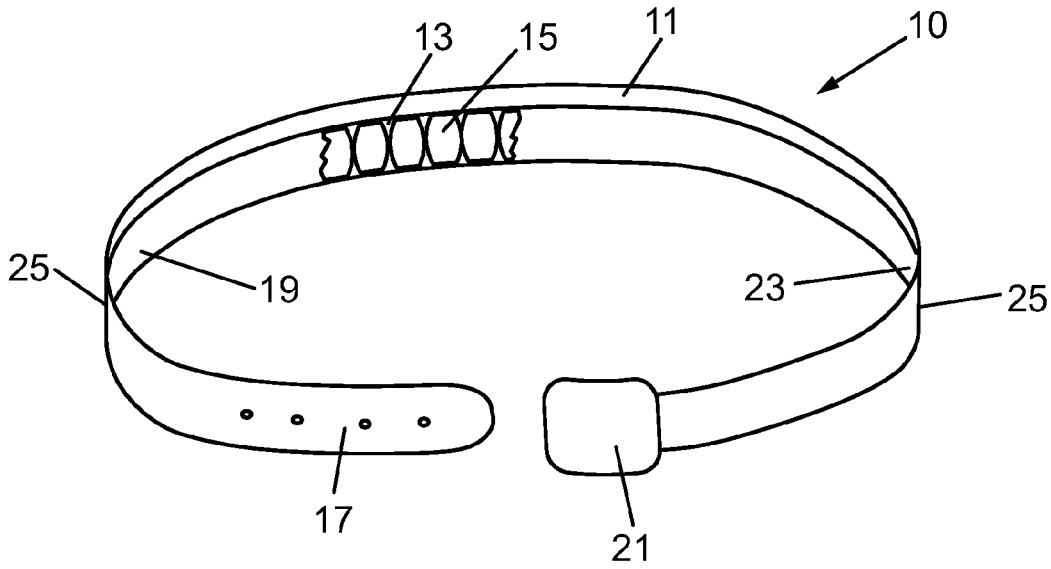
FIG. 1 is a cut-away perspective view of a belt according to an embodiment of the present invention.

Referring to FIG. 1, a weighted belt 10 is illustrated according to an embodiment of the present invention. The weighted belt 10 comprises a belt body 11 that defines a body pocket 13; a plurality of weights 15 disposed within the body pocket 13; a first cinching end 17 that extends from an end 19 of the belt body 11; and, a second cinching end 21 that extends from an opposite end 23 of the belt body 11. The first and second cinching ends (17, 21) comprise a suitable dress-belt material disposed on at least a portion of the surface 25 of the belt body 11 sufficient to conceal at least partially the belt body 11 when worn and viewed face on, and are configured for releasable engagement.

In a preferred embodiment, the belt body 11 has a length sufficient to span a belt wearer's back and at least a portion of the belt wearer's sides. However, it will be apparent to those skilled in the art that the selected length of the belt body 11 may be determined by the wearer's needs. For example, the belt body 11 may have a length sufficient to span a belt wearer's back, sides and at least a portion of the belt wearer's front.

The body pocket 13, which preferably runs the length of the belt body 11, may be sized as required.

The dress-belt material may be leather or a material made to resemble leather. Any material that is made to resemble a dress-belt material may be employed, such as various natural or synthetic fabrics. It will be understood that the particular material selected may be determined by the wearer's dress style. For example, if a business look is required, a material appropriate for a business environment would be selected. If the belt is to be worn in a less formal environment, a belt incorporating the appropriate material may be selected. The cinching ends 17, 21 may be connected to the belt body 11 by any means known to those skilled in the art. For example, they may be stitched, stapled, riveted or adhered to the belt body 11.

Figure 2:
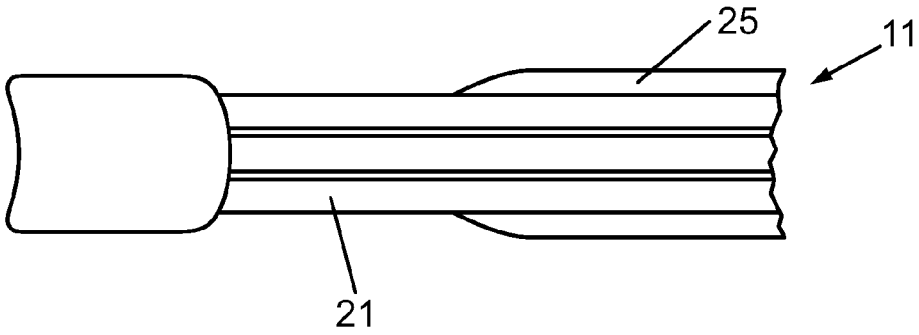
FIG. 2 is plan view of an end of the belt of FIG. 1.

Referring to FIG. 2, the cinching end 21 of the weighted belt 10 is illustrated. The cinching end 21 extends from end 23 of the belt body 11. FIG. 2 also illustrates that the end 21 is disposed on at least a portion of the surface 25 sufficient to conceal at least partially the belt body 11 when the belt 10 is worn and viewed face on. The cinching ends 17,21 serve at least two functions; the first being to secure releasably the belt 10 on the wearer's waist; the second being to conceal at least the portion of the belt body 11 that is viewable when the belt 10 is worn. In an alternate embodiment, the cinching ends 17,21 completely conceal the belt body 11.

Figure 3:
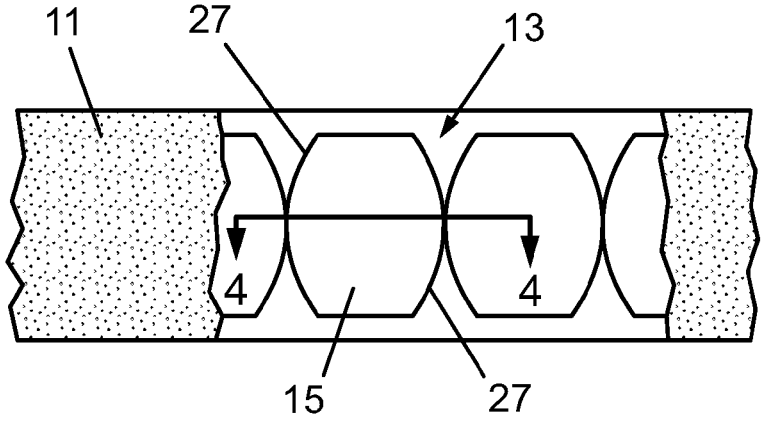
FIG. 3 is a cut-away plan view of a portion of the belt of FIG. 1.

Referring to FIG. 3, a cut-away portion of the belt body 11 is illustrated. The cut-away exposes the plurality of weights 15, which are aligned side-by-side when the weights 15 are disposed within the belt body 11. Each weight 15 preferably has curved sides (or face) 27, each of which providing an articulating surface for interacting with a curved side 27 of an adjacent weight 15. The curved sides 27 give each weight 15 a generally flattened or truncated ellipsoid shape in outline (as is illustrated in FIGS. 3 and 5(*b*)).

Figure 4:
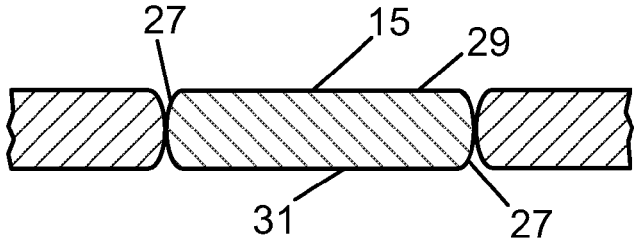
FIG. 4 is a cross-sectional view the plurality of weights of the belt of FIG. 1.

Referring to FIG. 4, a transverse cross-sectional profile of the weights 15 of FIG. 3 are illustrated. Each of the weights 15 has opposing inside and outside faces (29, 31), in addition to the opposing side faces 27. Preferably, the inside and outside faces (29, 31) are generally parallel to each other. While the faces 29, 31 may define a flat or uncurved surface, they may be slightly curved. For example, the inside face 29 may be slightly cupped (or concave) over its length and the outside face 31 may define a complementary bowed (or convex)

surface. The cupped inside face 29 would be positioned adjacent the body when the weighted belt 10 is in use. It will be apparent to those skilled in the art that the inside face 29 need not be cupped and that the outside face 31 need not have a complementary bowed surface. The size of the weights 15 and the degree of curving may be varied to suit the particular user's weighting requirements.

Figure 5A:
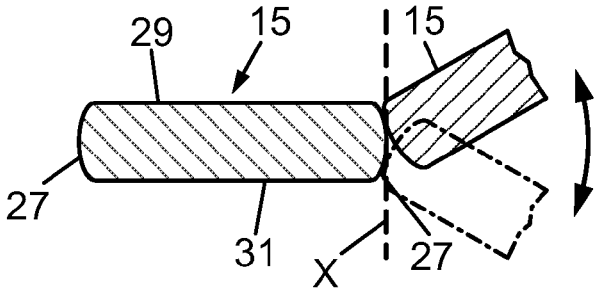
FIG. 5*a* is a cross-sectional view illustrating relative movement of adjacent weights of the belt of FIG. 1.
Figure 5B:
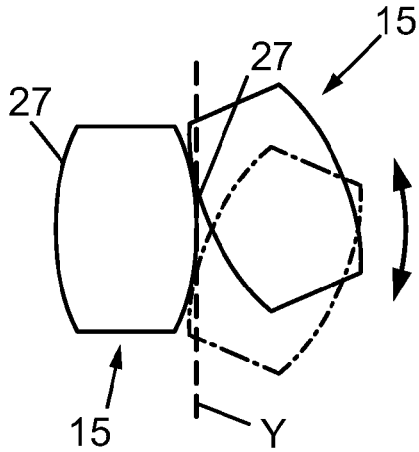
FIG. 5*b* is a plan view illustrating relative movement of adjacent weights of the belt of FIG. 1.

Still referring to FIG. 4 and referring to FIG. 5(*a*), the opposing side faces 27 of weight 15 are illustrated. The side faces are preferably rounded when viewed in transverse cross-section, thereby providing an articulating surface to engage the side face 27 of an adjacent weight 15. The degree of curvature provided may be varied according to the range of articulating motion required. For example, a 180° of curvature may be used if a belt having a relatively short radius of curvature were required, while a smaller degree of side 27 curvature may be used to provide a belt with a longer radius of curvature. In each case, however, the curved face 27 provides an articulating surface, which permits the weighted belt 10 to more closely hug the waist of a user. The curved face 27 may also permit closer alignment of the weights 15 compared to weights not having curved faces 27.

Referring to FIG. 3 and referring to FIG. 5(*b*), the opposing side faces 27 of weight 15 are illustrated. The side faces are preferably rounded when viewed in longitudinal cross-section, thereby providing an articulating surface to engage the side face 27 of an adjacent weight 15. The degree of curvature provided may be varied according to the range of articulating motion required. The curved face 27 provides an articulating surface, which permits, among other things, the wearer of the weighted belt 10 to more easily bend at the waist.

Referring to FIGS. 5(*a*) and 5(*b*), the weights 15 are illustrated in relation to each other. The curved faces 27 provide articulating surfaces along respective axes of movement (X, Y). Preferably, each of the plurality weights 15 articulates with an adjacent weight 15 in at least the two axes of movement (X, Y).

Figure 6:
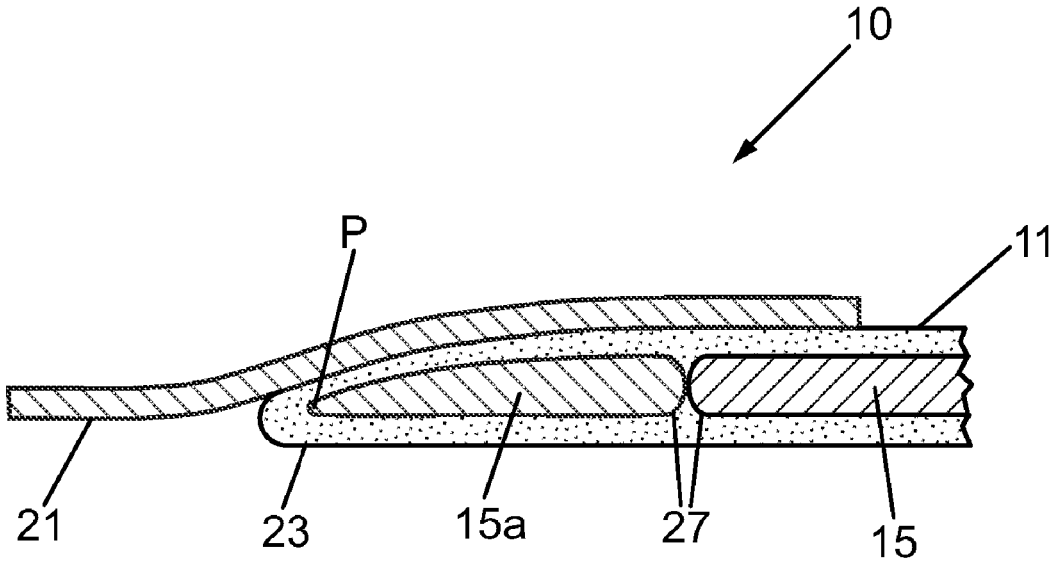
FIG. 6 is a transverse cross-sectional view illustrating an end of the belt of FIG. 1.

Referring to FIG. 6, a transverse cross-sectional view of an end of the belt 10 is illustrated. A terminal weight 15*a* is illustrated in the belt's 10 assembled position. Unlike the shape of weight 15, the terminal weight 15*a* is preferably tapered at a terminal point P. In the transverse cross-sectional view, the terminal weight 15*a* is almost bullet shaped. This particular shape allows for a smoother transition from the belt body end (e.g., 23) to the cinching end (e.g., 21) than would otherwise be the case. It will be apparent to those skilled in the art that any shape or configuration that provides a smoother transition may be employed.

In a preferred embodiment, each of the plurality of weights comprises a lead alloy, such as lead and antimony. The lead alloy comprises about 97% lead and about 3% antimony. The lead alloy preferably comprises at least 96% lead and at least 2.9% antimony. More particularly, the lead alloy comprises from 96.7% to 97.1% lead and from 2.9% to 3.3% antimony. The lead alloy may also contain other elements in trace amounts, such as nickel, silver and copper (see table below). The respective amounts of these trace elements may vary with factors such as the source of the raw material and the efficiency of the alloy production process. The non-lead elemental composition of a sample batch of weight 15 is provided in the table below.

Weight 15 elemental analysis:

| Element | Specification Limit | Analysis (%) |
|---|---|---|
| Sb | 2.90 and 3.25 | 3.18 |
| Sn | 0.15 and 0.25 | 0.21 |

-continued

| Element | Specification Limit | Analysis (%) |
|---|---|---|
| As | 0.15 and | 0.22 |
| Cu | less than 0.04 | <0.001 |
| Bi | less than 0.05 | 0.01 |
| Ag | less than 0.10 | 0.03 |
| Ni | less than 0.001 | <0.001 |
| S | less than 0.001 | <0.001 |

Figure 7A:
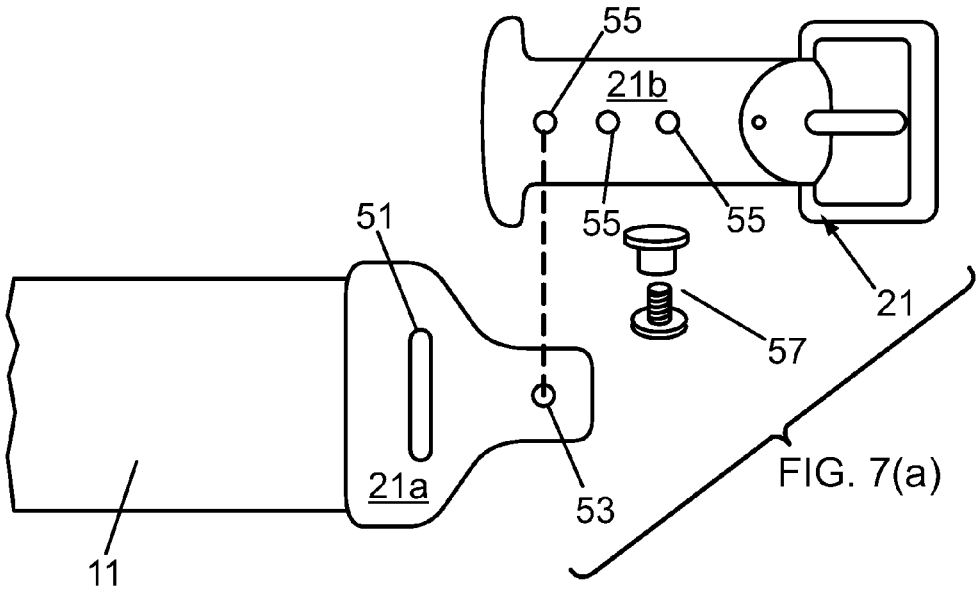
FIG. 7*a* is a expanded view of the second cinching end illustrated according to an alternate embodiment; and, FIG. 7*b* is a expanded view of the first cinching end illustrated according to an alternate embodiment.
Figure 7B:
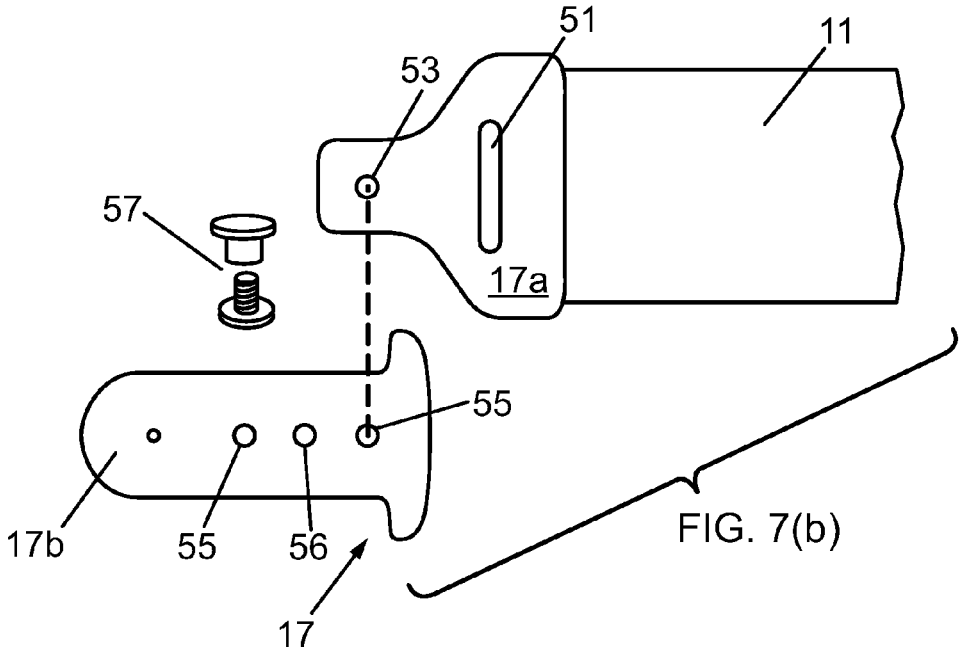

Referring to FIGS. 7(*a*) and 7(*b*), an alternate embodiment of cinching ends 17 (FIG. 7(*b*)) and 21 (FIG. 7(*a*)) is illustrated. FIG. 7(*a*) illustrates the belt buckle (or second) cinching end 21, which preferably comprises a two-part structure, 21*a* and 21*b*.

Part 21*a* is secured to the belt body 11, and comprises a slot 51 passing through the part 21*a*. The slot 51 is sized to receive part 21*b*. Once positioned within the slot 51, part 21*b* may slide therethrough along its length. In so sliding, the overall length of the weighted belt 10 may be adjusted to a desired length. Once the desired length is obtained, parts 21*a* and 21*b* can be releasably secured.

In a preferred embodiment, part 21*a* is configured with a hole 53, which is positioned along the sliding axis part 21*b*. The hole 53 may be co-aligned with a corresponding any one of a series of holes 55 that are positioned on part 21*b*. The holes 55 are also positioned along the sliding axis.

Accordingly, once a desired belt 10 length has been determined, the holes 53 and 55 at the desired length are co-aligned. The parts 21*a* and 21*b* may then be secured with any one of a suitable releasable securing means known to those skilled in the art. In a preferred embodiment, the securing means may be a post and screw 57 (e.g., Chicago screw) as is known in the art.

Referring to FIG. 7(*b*), the cinching end 17 is illustrated as similarly configured to the cinching end 21. The cinching end 17 also comprises a two-part structure 17*a* and 17*b*, with part 17*a* being secured to the belt body 11 and part 17*b* slidingly engaging part 17*a* in the same manner as parts 21*a* and 21*b* engage. As such, part 17*a* is also configured with a slot 51 and hole 53, and part 17*b* is configured with a series of holes 55; the slot 51, hole 53 and holes 55 all being positioned along the sliding axis defined by the co-action of parts 17*a* and 17*b*. As with parts 21*a* and 21*b*, the parts 17*a* and 17*b* may be secured with any one of a suitable releasable securing means known in the art, such as the post and screw 57.

The above description is intended in an illustrative rather than restrictive sense. Variations may be apparent to those skilled in the art without departing from the spirit and scope of the invention as defined by the claims set out below.

I claim:

1. A weighted belt comprising:

a belt body defining a body pocket, said pocket having a height;

a plurality of weights each disposed within the body pocket and each extending as continuous solid material along said entire height, wherein each of the plurality of weights has curved side surfaces and articulates in direct contact with an adjacent said weight in at least two axes of movement;

wherein each of the plurality of weights is truncated elliptical in outline;

a first said axis of movement extending vertically between adjacent said weights and a second said axis of movement extending horizontally from each said first axis, wherein a curvature of said curved side surfaces of each of said weights in a side view extends along said first axis and in a transverse cross-sectional view extends along said second axis such that during said articulating said curved side surfaces of each of said weights contacts said curved side surfaces of an adjacent said weight about said axes;

a first cinching end extending from an end of the belt body; and, a second cinching end extending from an opposite end of the belt body, the first and second cinching ends:

comprising a suitable dress-belt material disposed on at least a portion of the surface of the belt body sufficient to conceal at least partially the belt body when worn and viewed face on, and being configured for releasable engagement.

2. A weighted belt according to claim 1, wherein the belt body has a length sufficient to span a belt wearer's back and at least a portion of the belt wearer's sides.

3. A weighted belt according to claim 1, wherein the body pocket runs the length of the belt body.

4. A weighted belt according to claim 1, wherein the dress-belt material is leather.

5. A weighted belt according to claim 1, wherein the dress-belt material is a material made to resemble leather.

6. A weighted belt according to claim 1, wherein each of the plurality of weights comprises a lead alloy.

7. A weighted belt according to claim 6, wherein the lead alloy comprises lead and antimony.

8. A weighted belt according to claim 7, wherein the lead alloy comprises about 97% lead and about 3% antimony.

9. A weighted belt according to claim 7, wherein the lead alloy comprises at least 96% lead and at least 2.9% antimony.

10. A weighted belt according to claim 9, wherein the lead alloy comprises from 96.7% to 97.1% lead and from 2.9% to 3.3% antimony.

11. A weighted belt comprising:

a belt body defining a body pocket, said pocket having a height, the belt body having a length sufficient to span a belt wearer's back and at least a portion of the belt wearer's sides;

a plurality of weights each disposed within the body pocket and each extending as continuous solid material along said entire height, wherein each of the plurality of weights has curved side surfaces and articulates in direct contact with an adjacent said weight in at least two axes of movement;

wherein each of the plurality of weights is truncated elliptical in outline;

a first said axis of movement extending vertically between adjacent said weights and a second said axis of movement extending horizontally from each said first axis, wherein a curvature of said curved side surfaces of each of said weights in a side view extends along said first axis and in a transverse cross-sectional view extends along said second axis such that during said articulating said curved side surfaces of each of said weights contacts said curved side surfaces of an adjacent said weight about said axes;

a first cinching end extending from an end of the belt body; and, a second cinching end extending from an opposite end of the belt body, the first and second cinching ends:

comprising a suitable dress-belt material disposed on at least a portion of the surface of the belt body sufficient to conceal at least partially the belt body when worn and viewed face on, and being configured for releasable engagement.

12. A weighted belt according to claim 11, wherein each of the plurality of weights comprises a lead alloy.

13. A weighted belt according to claim 12, wherein the lead alloy comprises lead and antimony.

14. A weighted belt according to claim 13, wherein the lead alloy comprises at least 96% lead and at least 2.9% antimony.

15. A weighted belt according to claim 13, wherein the lead alloy comprises about 97% lead and about 3% antimony.

16. A weighted belt according to claim 11, wherein at least one of the first and second cinching ends is releasably securable to the belt body and repositionable along its length relative to the belt body so as to alter the overall length of the weighted belt.

17. A weighted belt according to claim 11, wherein the first cinching end is releasably securable to the belt body and repositionable along its length relative to the belt body so as to alter the overall length of the weighted belt.

18. A weighted belt according to claim 11, wherein the second cinching end is releasably securable to the belt body and repositionable along its length relative to the belt body so as to alter the overall length of the weighted belt.

* * * * *